US012473708B2

(12) United States Patent
Hefner

(10) Patent No.: US 12,473,708 B2
(45) Date of Patent: Nov. 18, 2025

(54) WHEEL OR TRACK LOADER AND SELF-LOADING AGGREGATE DISPENSER

(71) Applicant: James Hefner, Grafton, WV (US)

(72) Inventor: James Hefner, Grafton, WV (US)

( * ) Notice: Subject to any disclaimer, the term of this patent is extended or adjusted under 35 U.S.C. 154(b) by 728 days.

(21) Appl. No.: 17/814,421

(22) Filed: Jul. 22, 2022

(65) Prior Publication Data

US 2023/0047650 A1 Feb. 16, 2023

Related U.S. Application Data

(60) Provisional application No. 63/260,122, filed on Aug. 10, 2021.

(51) Int. Cl.
*E02F 3/407* (2006.01)

(52) U.S. Cl.
CPC ..... *E02F 3/4075* (2013.01)

(58) Field of Classification Search
CPC ... E02F 3/4075; E02F 3/04; E02F 3/12; E02F 3/14; E02F 3/141; E02F 3/28; E02F 3/34; E02F 3/3414; E02F 3/3417; E02F 3/40; E02F 3/404
USPC ..... 37/406, 409, 411, 419
See application file for complete search history.

(56) References Cited

U.S. PATENT DOCUMENTS

| | | | | |
|---|---|---|---|---|
| 3,341,041 | A * | 9/1967 | Salna | E02F 3/3408 37/442 |
| 3,344,540 | A * | 10/1967 | Ulrich | E02F 3/4133 37/406 |
| 3,598,266 | A | 8/1971 | Fisher | |
| 5,692,875 | A | 12/1997 | Boman | |
| 7,934,899 | B2 * | 5/2011 | Downing | E02F 3/40 414/722 |
| 2005/0169739 | A1 | 8/2005 | Raley | |

* cited by examiner

*Primary Examiner* — Christopher J Sebesta
*Assistant Examiner* — Evan A Bregel
(74) *Attorney, Agent, or Firm* — Dunlap Bennett & Ludwig, PLLC

(57) ABSTRACT

An assembly designed for use on a bucket of a wheel or track loader is herein disclosed. The assembly generally includes a material discharge component and at least one actuator. The material discharge component includes a left-side arm, a right-side arm, a front wall section extending between the arms, a top plate extending between the arms and coupled to a top edge of the arms, and a bottom plate. The at least one actuator is coupled to one of the arms and is designed to be coupled to the bucket. In use, the at least one actuator moves the material discharge component between open and closed positions. Further, when the bucket is tilted forwardly, material is dispensable through the opening.

14 Claims, 13 Drawing Sheets

WHEEL OR TRACK LOADER AND SELF-LOADING AGGREGATE DISPENSER

CROSS-REFERENCE TO RELATED APPLICATION

This application claims the benefit of priority of U.S. provisional application No. 63/260,122, filed Aug. 10, 2021, the contents of which are herein incorporated by reference.

BACKGROUND OF THE INVENTION

The present invention relates to dispensing aggregates, and more particularly, to a wheel or track loader self-loading center-dispensing bucket.

FIG. 1 shows a prior art device 10 for dispensing aggregates (including, but not limited to, a skid steer and other track loaders). Such a prior art device 10 includes a bucket 12 that provides no precision when dispensing aggregates in general and, in particular, in tight spaces. Due to the lack of precision, there are significant resultant increases in the amount of time and labor required for construction projects, such as backfilling a trench.

As can be seen, there is a need for a device that provides time and labor savings in dispensing aggregates.

SUMMARY OF THE INVENTION

In one aspect of the present invention, an assembly adapted for use on a bucket of a loader is disclosed, with the assembly comprising: a material discharge component comprising: a left-side arm and a right-side arm, with each arm being adapted to pivotally couple with the bucket; a front wall section converging in a V-shape from a front end of the left-side arm and the right-side arm, with an opening being defined in the front wall section; a top plate coupled to a top edge of the left-side arm and a top edge of the right-side arm; and a bottom plate extending rearwardly from a bottom edge of the front wall section; and a first actuator coupled to one of the left-side arm and the right side arm and adapted to be coupled to the bucket, the first actuator further being adapted to operate the material discharge component between an open position and a closed position, whereby material is dispensable through the opening when the bucket is tilted forwardly.

In another aspect of the present invention, a material discharging apparatus is disclosed that comprises: a loader comprising a bucket; and an assembly used on the bucket of the loader, the assembly comprising: a material discharge component comprising: a left-side arm and a right-side arm, with each arm being pivotally coupled with the bucket; a front wall section converging in a V-shape from a front end of the left-side arm and the right-side arm, with an opening being defined in the front wall section; a top plate coupled to a top edge of the left-side arm and a top edge of the right-side arm; and a bottom plate extending rearwardly from a bottom edge of the front wall section; and a first actuator coupled to one of the left-side arm and the right side arm and coupled to the bucket, the first actuator further being adapted to operate the material discharge component between an open position and a closed position, whereby material is dispensable through the opening when the bucket is tilted forwardly.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
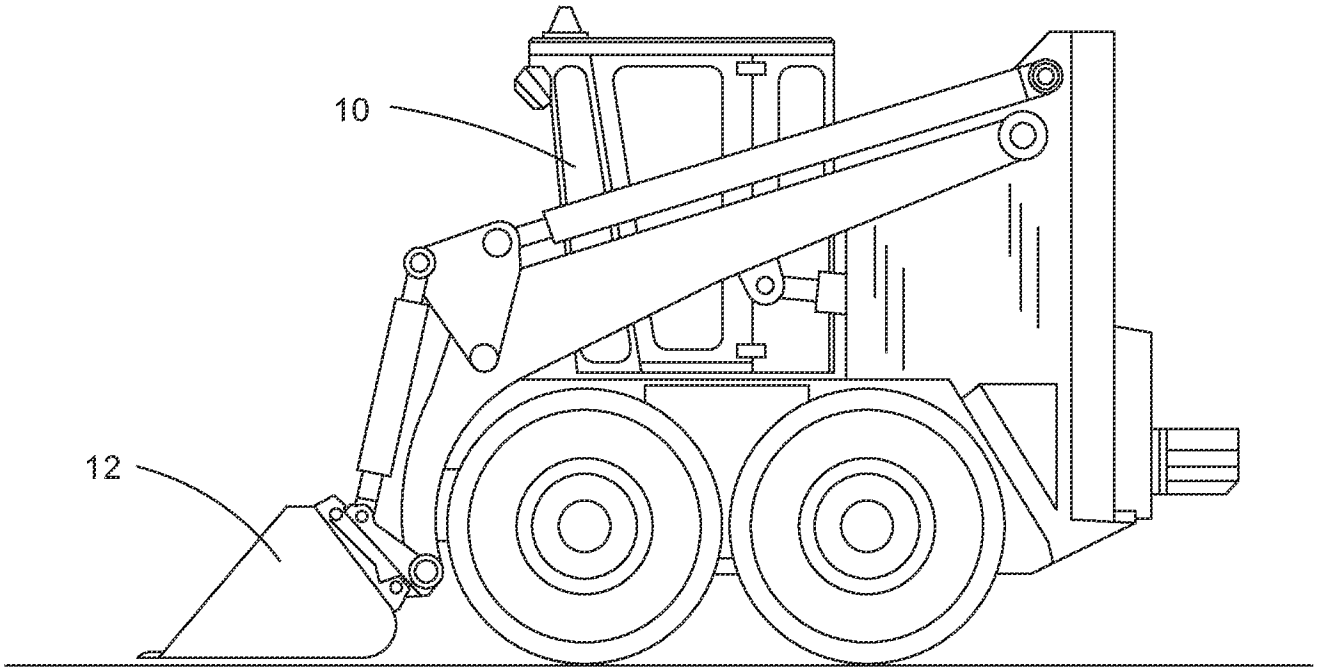
FIG. 1 (PRIOR ART)
FIG. 1 shows a prior art wheeled vehicle loader with an articulating bucket.

The following detailed description is of the best currently contemplated modes of carrying out exemplary embodiments of the invention. The description is not to be taken in a limiting sense but is made merely for the purpose of illustrating the general principles of the present invention.

Broadly, an embodiment of the present invention provides a wheel or track loader 11 provisioned with a bucket 14 and a material discharge component 16 and a method for loading and dispensing materials 30, such as aggregates, sand, soil, and the like. The present invention provides a time and labor-saving material dispenser capable of being attached to a loader 11. In some embodiments, the dispenser comprises a loader 11, an articulating bucket 14, and a hydraulically activated material discharge component 16. The bucket 14 may be loaded by opening the material discharge component 16 and submersing the bucket 14 into material 30 to be dispensed so that the material 30 is collected in a receptacle portion of the bucket 14. In other embodiments, the material dispenser comprises an integral bucket 14 and material discharge component 16 having a central dispensing opening 26, and the bucket 14 may be loaded by other construction equipment.

The system of the present invention provides an advancement over prior art devices, an example of such prior art devices is shown at FIG. 1. As seen at FIG. 1, the use of such prior art devices 10 that include conventionally designed buckets 12 for dispensing aggregates is cumbersome, time-consuming, wasteful, and causes negative impact to a construction site, requiring clean up after use. The present invention is particularly adapted for use in dispensing aggregates 30 into tight spaces, such as covering drain tile, pipes, and backfill for trenches and other linear excavations.

Figure 4:
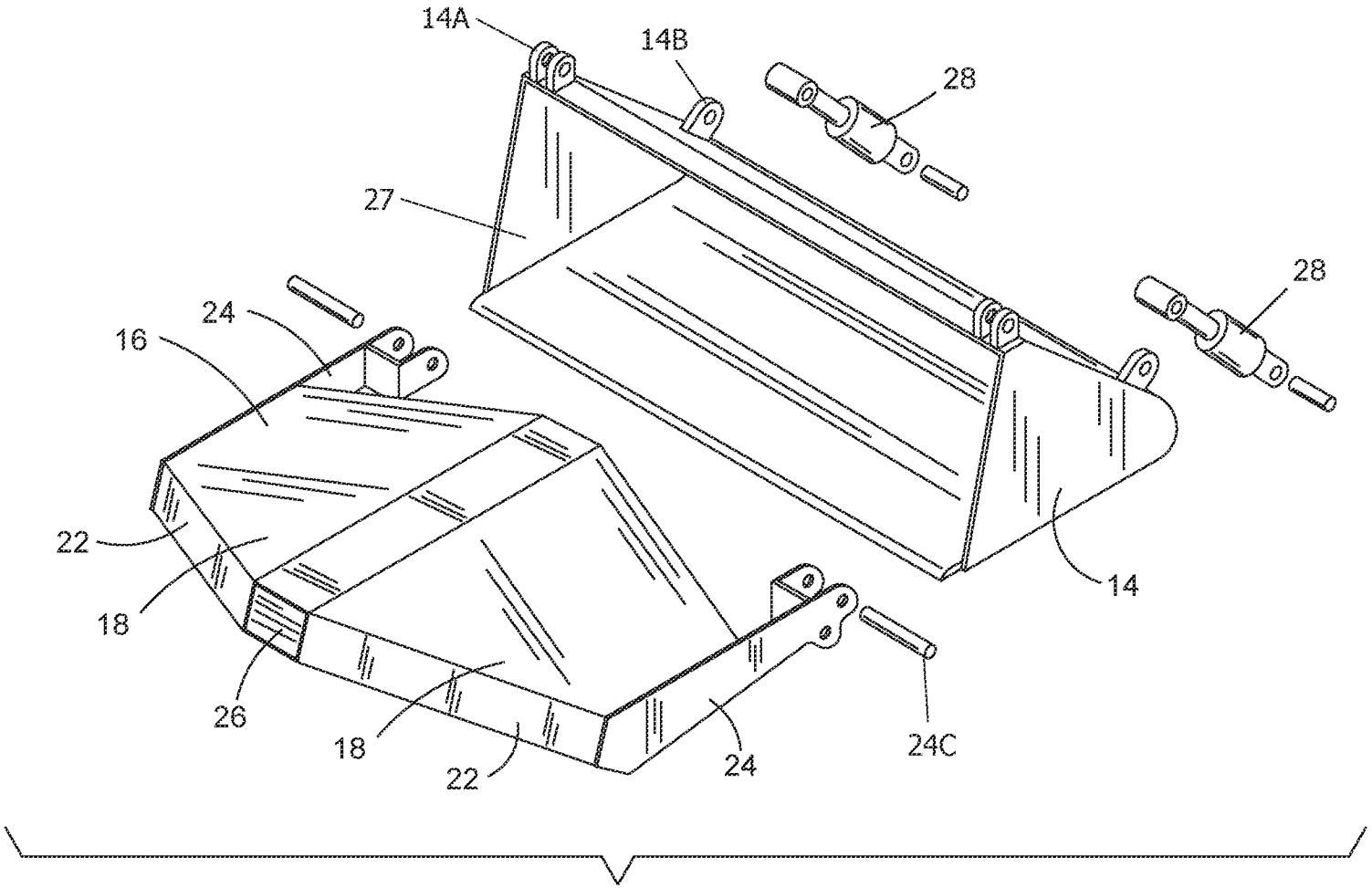
FIG. 4 is an exploded front perspective view showing major components of the bucket with a material discharge component.
Figure 6:
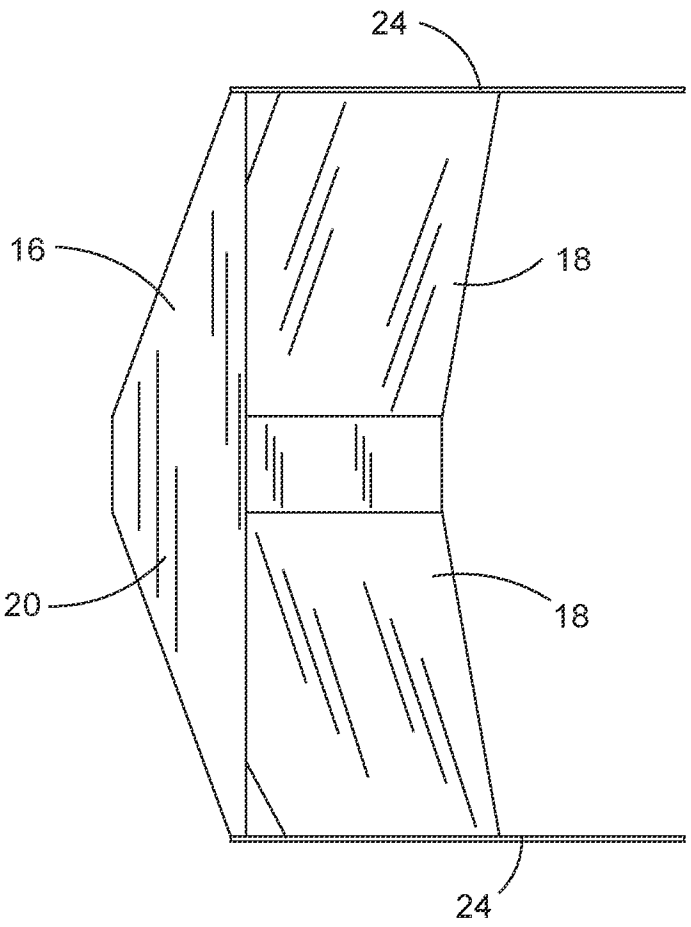
FIG. 6 is a bottom plan view of the material discharge component.
Figure 5:
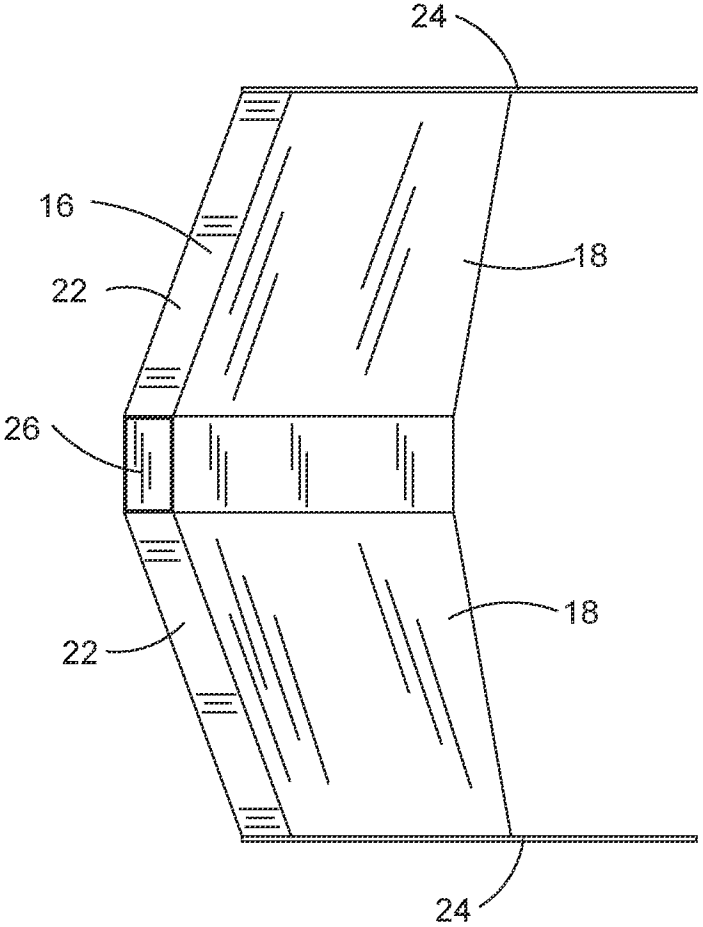
FIG. 5 is a top plan view of the material discharge component.
Figure 8:
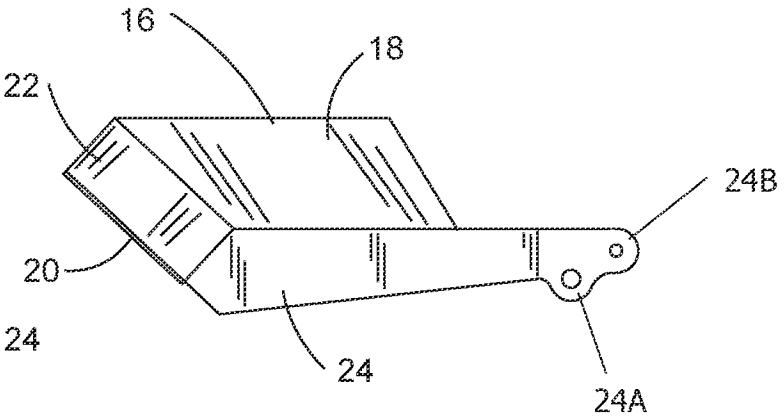
FIG. 8 is a left side elevation view of the material discharge component, the right side being a mirror image thereof.
Figure 7:
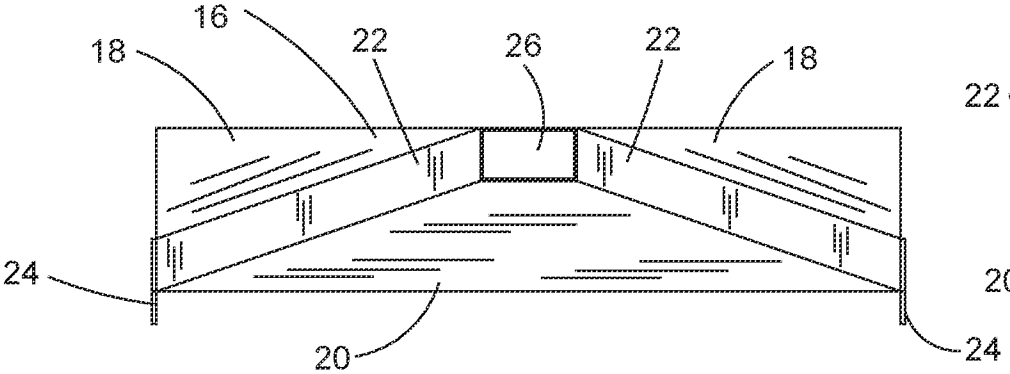
FIG. 7 is a front elevation view of the material discharge component.
Figure 9:
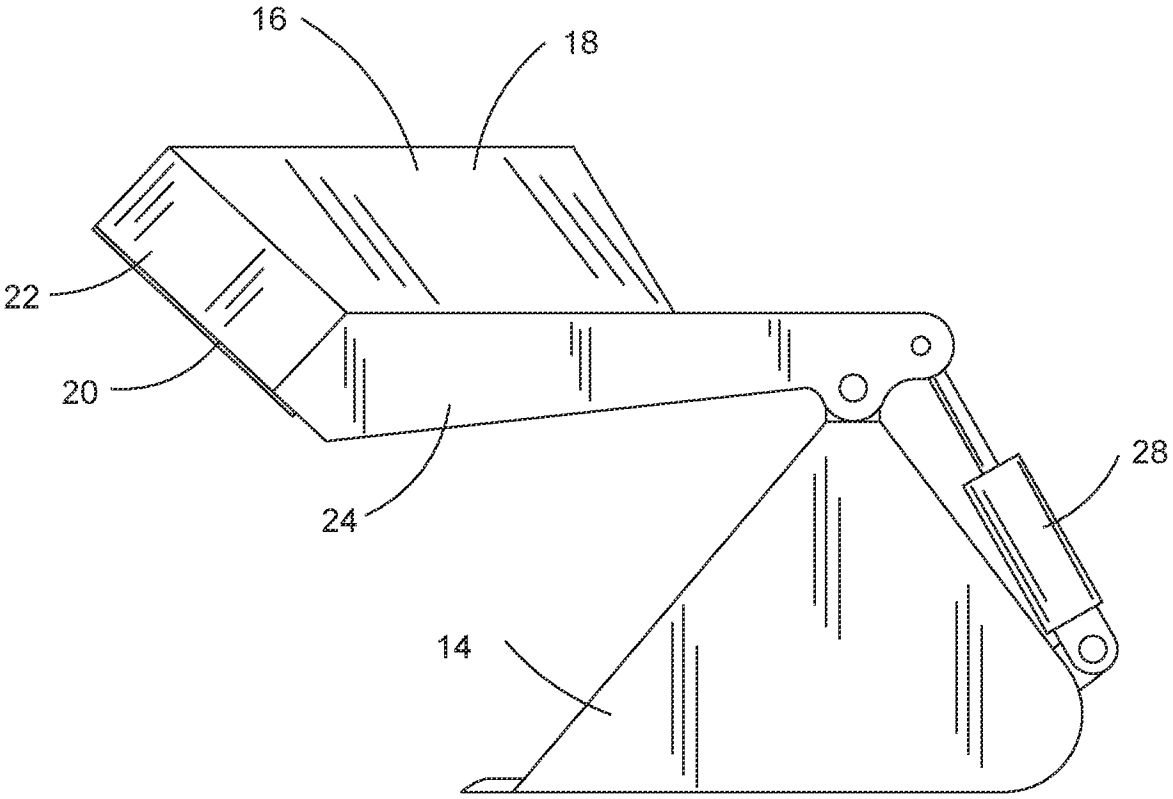
FIG. 9 is a side elevation view of the material discharge component coupled to the bucket shown in an open condition.
Figure 10:
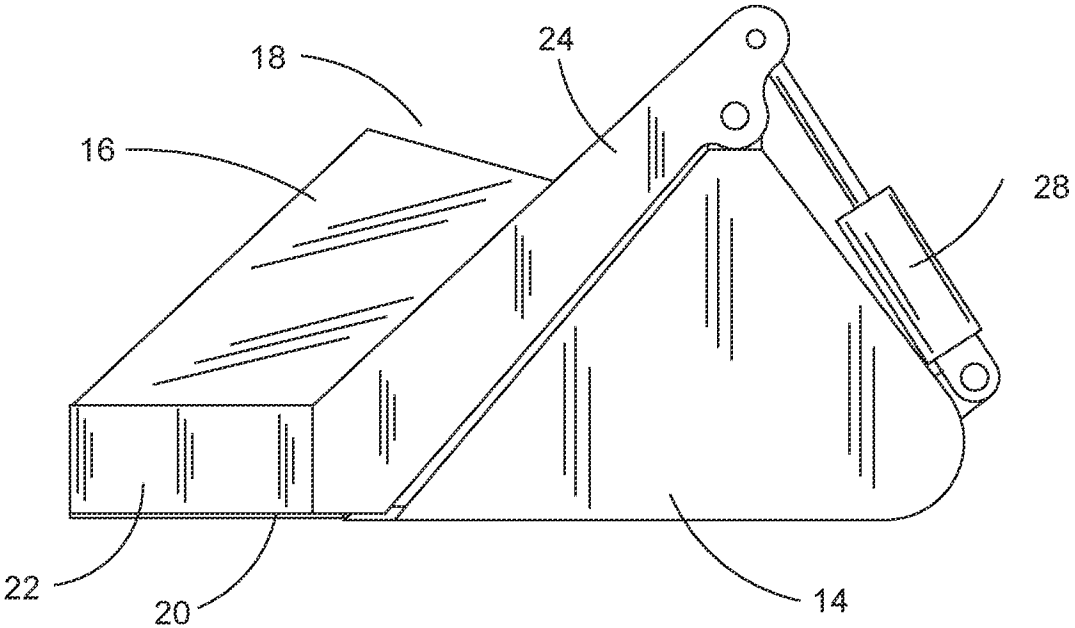
FIG. 10 is a side elevation view of the material discharge component coupled to the bucket shown in a closed condition.

As seen, for example, at FIGS. 2-10, the present invention may provide a material dispensing apparatus 40. The material dispensing apparatus 40 may comprise a self-loading wheel or track loader 11 and a bucket 14 pivotally coupled to articulating load arms 13 of the loader 11. A material discharge component 16 is pivotally coupled to an aft end (i.e., a rear end) of the bucket 14 and is operable between an open position and a closed position by an actuator 28 (which may be comprised of a pair of actuators 28, as shown in FIG. 4).

The material discharge component 16 has a left and a right-side arm 24. A pivot 24A and an actuator coupling 24B (spaced from the pivot 24A) are provided at an aft end of the left and the right-side arms 24. Each pivot 24A rotatably couples engages a first bucket bracket 14A that is disposed on an upper surface of the bucket 14. The actuator 28 is rotatably coupled to the material discharge component 16 at the actuator coupling 24B via a pin 24C and is pivotally coupled to a lower aft end of the bucket 14 to a second bucket bracket 14B (such that the actuator 28 runs along the aft end of the bucket 14). The lower edge of the left and right-side arms 24 engage with a forwardly projecting edge of lateral sidewalls of the bucket 14.

The material discharge component 16 has a front wall section 22 that converges forwardly in a V shape from a front end of the left and the right-side arms 24. An opening 26 is defined at the convergence of the front wall section 22. A top plate 18 interconnects with a top edge of each of the left and right-side arms 24 and the front wall section 22. Preferably, the top plate 18 is elevated from each of the left and right-side arms 24 and the front wall section 22 to provide containment of a greater volume of material 30 in the opening 26 when the bucket A bottom plate 20 extends rearwardly from a bottom edge of the front wall section 22. An aft edge of the bottom plate 20 is configured such that it aligns with a lip extending laterally across a bottom edge of the bucket 14. The aft edge facilitates retention of the materials 30 within the bucket 14 when the material discharge component 16 is moved to the closed position.

Figure 11:
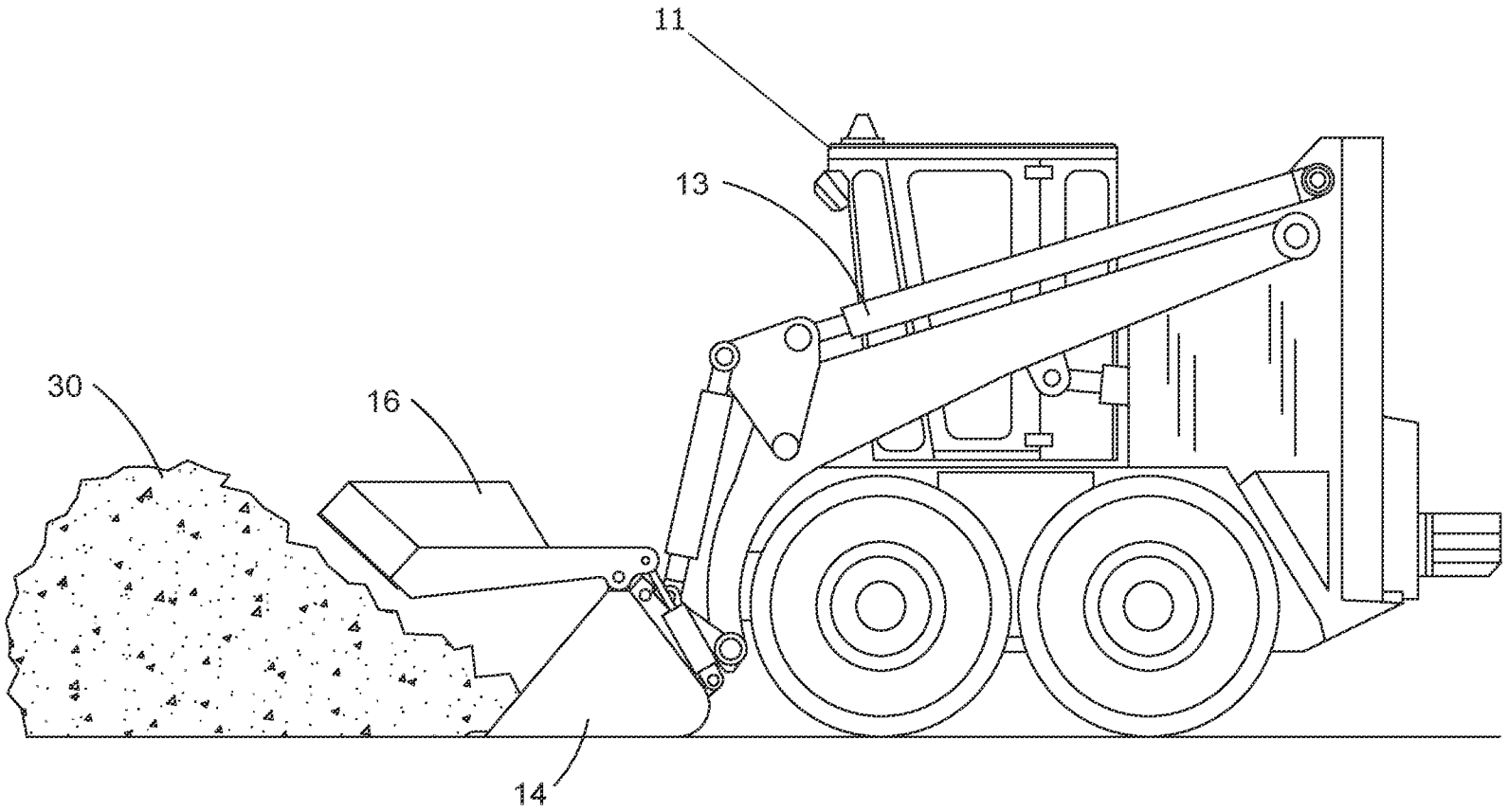
FIG. 11 is a side elevation view of the wheeled vehicle loader and articulating bucket with the material discharge component moved to the open condition for a material scooping operation.

In some embodiments, the material discharge component 16 may be actuated hydraulically via actuator 28 (which, as shown in FIG. 4 and mentioned above, may be a pair of actuators 28 positioned on opposite lateral ends of the bucket 14 that couple with respective pins 24C) to open and close the bucket 14 for loading of material 30. As shown at FIG. 11, the material discharge component 16 may be hydraulically lifted to enable the user to load the bucket interior 14 with a material 30 to be dispensed. Then, as seen in FIG. 12, after the bucket is loaded, the material discharge component 16 may be hydraulically lowered to pivot into place for use in dispensing the material 30 from the front opening 26 thereof.

The present invention and its components may be made of any suitable material by any suitable fabrication process. The present invention and its components may have any suitable dimensions, depending upon the size of the excavations to be filled and the size and capacity of the loader vehicle 11.

Figure 2:
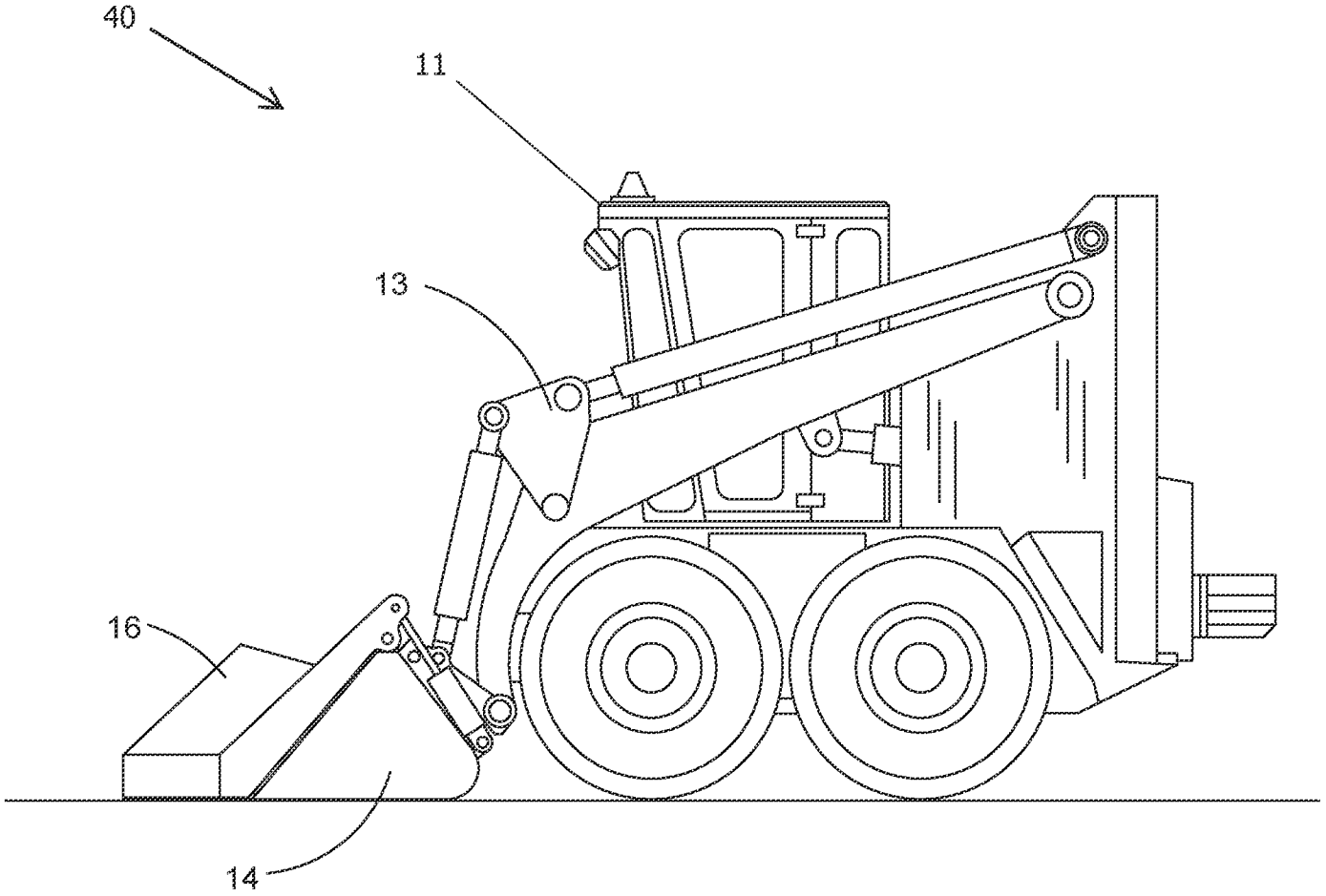
FIG. 2 is a schematic view of the wheeled vehicle loader and articulating bucket with a self-loading aggregate dispenser.
Figure 3:
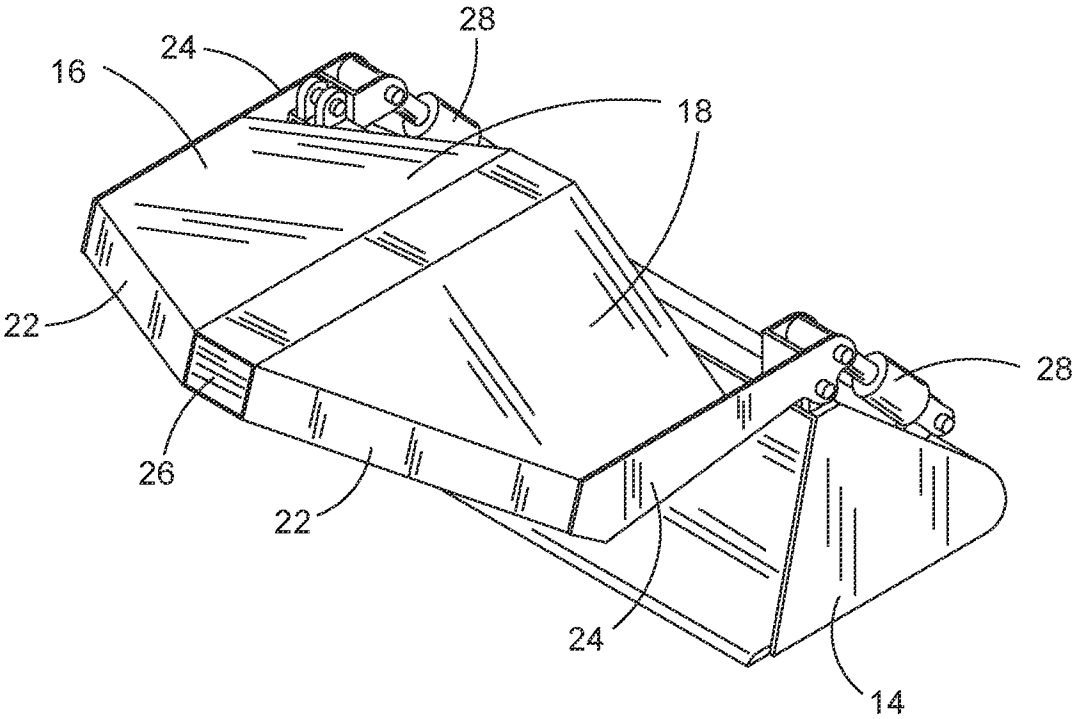
FIG. 3 is a front perspective view of the bucket with a material discharge component.

FIG. 11 shows an exemplary embodiment of the present invention as in FIG. 2, in use showing the bucket 14 being loaded with a material 30, a non-limiting example of which may be aggregate rock 30. It is seen that the pivotally mounted the material discharge component 16 is pivoted upward to enable the loading of the self-dispensing bucket 14 with the material 30 to be dispensed. In use, the dispenser bucket is loaded by any suitable construction equipment, such as, for example without limitation, pouring an aggregate slurry from a concrete truck or mixer.

Figure 12:
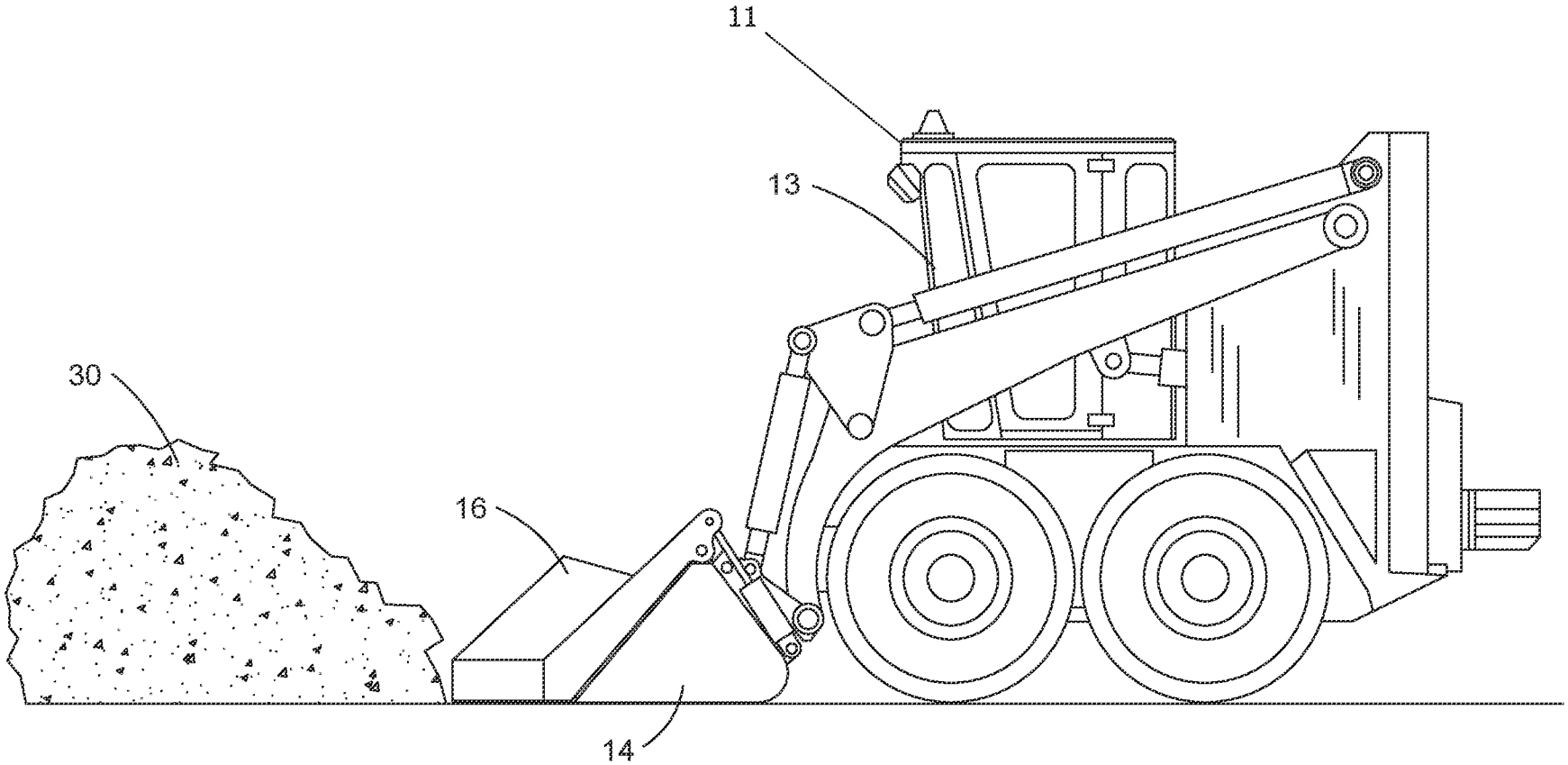
FIG. 12 is a side elevation view of the wheeled vehicle loader and articulating bucket with the material discharge component in the closed condition for a material containment operation.

Referring now to FIG. 12, the material discharge component 16 may be pivoted downward into place to close with a front edge and sides of the bucket 14 contain the loaded material 30 within the bucket 14.

Figure 13:
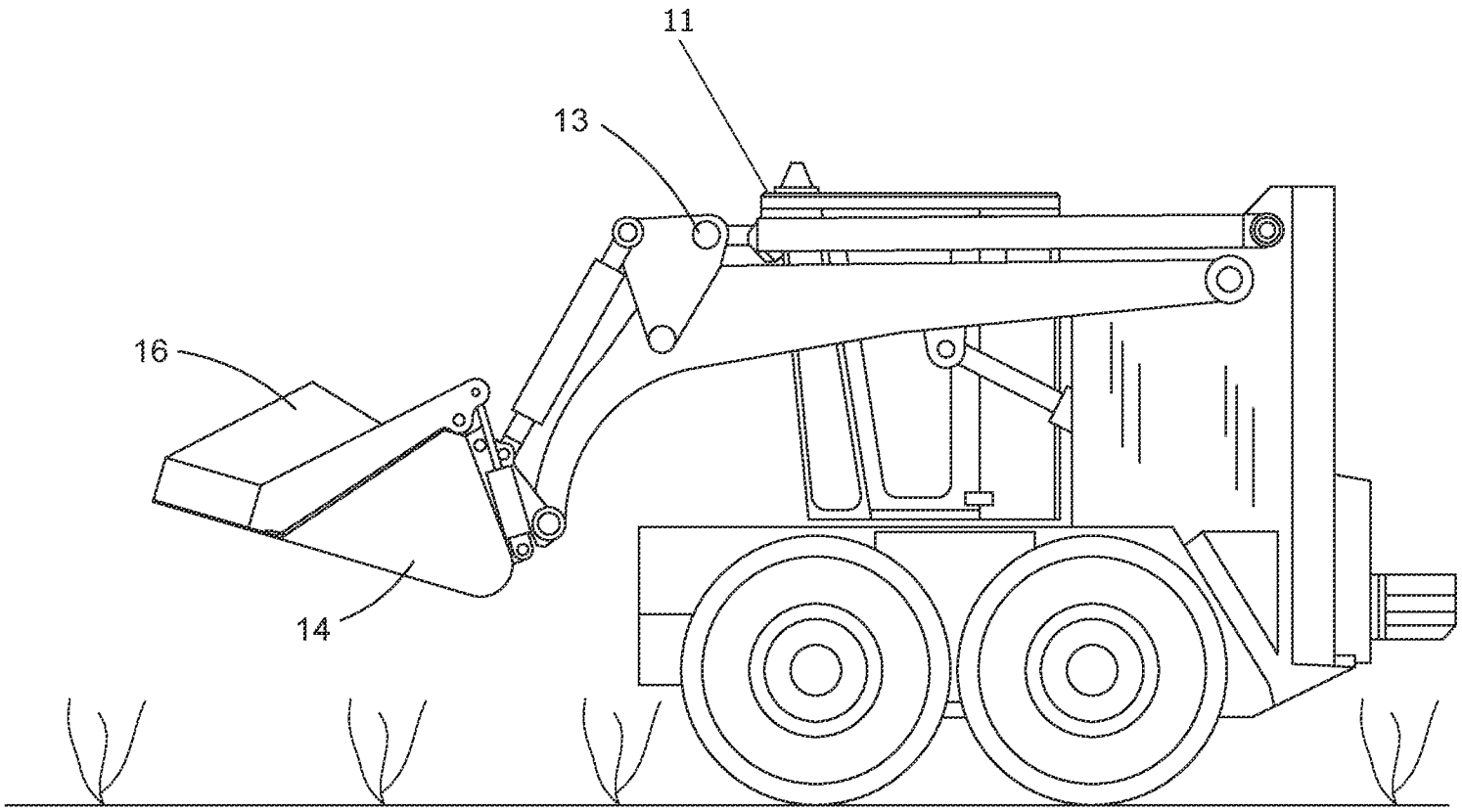
FIG. 13 is a side elevation view of the wheeled vehicle loader and articulating bucket with the material discharge component in the closed condition for a material transport operation.

Referring to FIG. 13, after the material discharge component 16 and bucket 14 are loaded with material 30 to be dispensed, the user may transport the materials in the bucket 14 to locations for dispensing of the materials 30 where the materials 30 are needed. The bucket 14 is pivoted rearwardly so that the materials 30 are contained within the bucket 14 and the material discharge component 16 and prevent materials from spilling from the opening 26.

Figure 14:
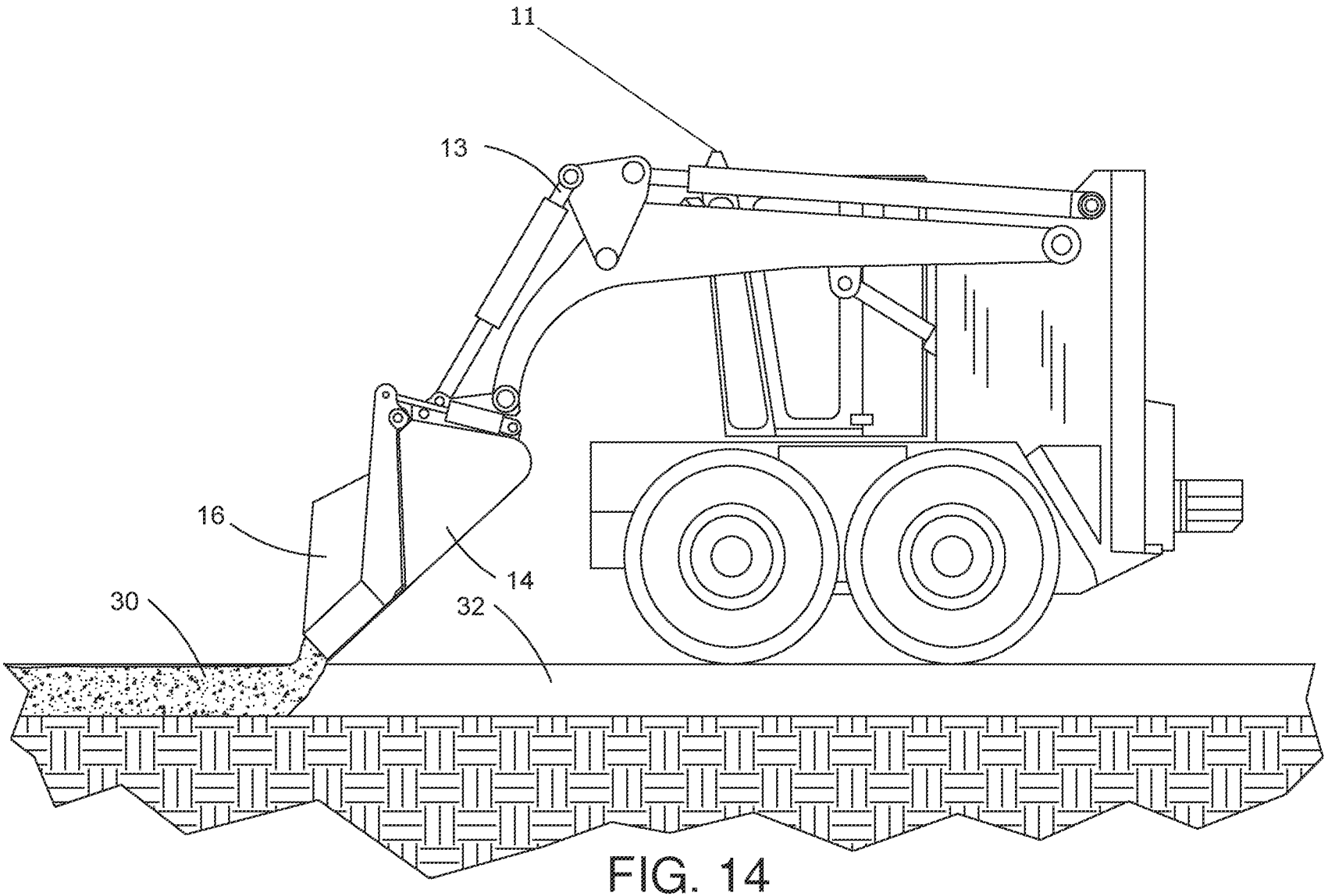
FIG. 14 is a side elevation view of the wheeled vehicle loader and articulating bucket with the material discharge component in the closed condition for a material dispensing operation.
Figure 15:
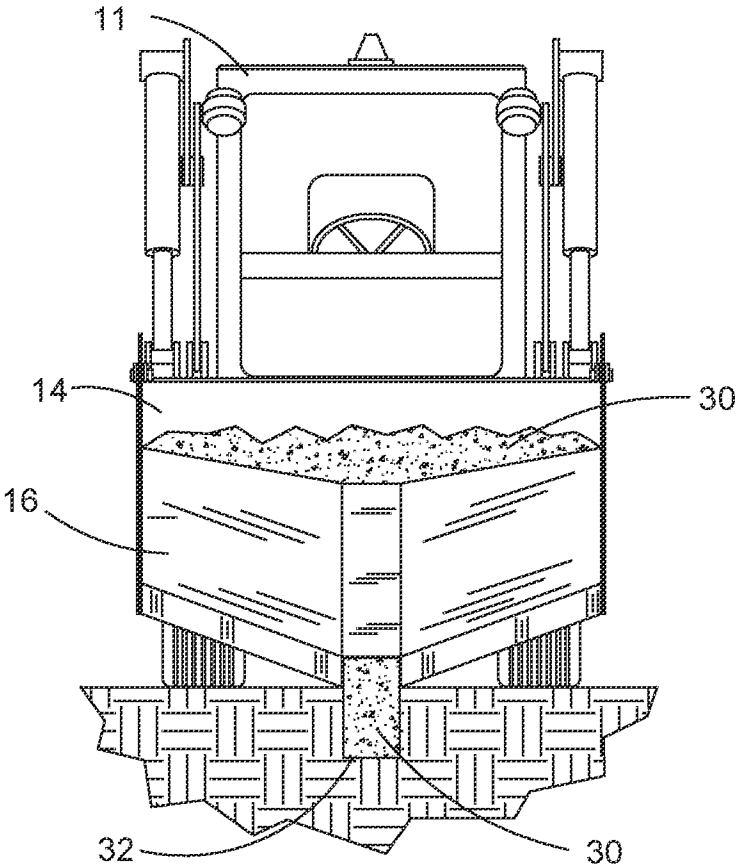
FIG. 15 is a front elevation view of the wheeled vehicle loader and articulating bucket with the material discharge component in the closed condition for a material dispensing operation.

As shown in FIGS. 14 and 15, when the operator has reached the desired excavation to fill, the opening 26 is positioned aligned with the trench. The bucket 14, with the material discharge component 16 retained in the closed position, is tilted forwardly so that the materials 30 are dispensed through the opening 26 into the excavation. The operator may adjust the dispensing rate of the apparatus by varying the tilt angle of the bucket 14. The elevated top plate 18 of the material discharge component 16 facilitates guidance of the material 30 through the opening 26.

The center-dispensing bucket of the present invention may be used to dispense any flowable material, such as, for example without limitation, concrete, sand, gravel, or the like. In use, the present invention may save time and money. Whether loaded by other construction equipment or self-loading, the center-dispensing device is completely unprecedented and was developed in response to a need for such a device.

For clarity, only those aspects of the system germane to the present invention are described, and product details well known in the art are omitted. In addition, many embodiments of the present invention have application to a wide range of industries. To the extent the present application discloses a system, the method implemented by that system is within the scope of the present invention. Further, to the extent the present application discloses a method, a system of apparatuses configured to implement the method are within the scope of the present invention.

It should be understood, of course, that the foregoing relates to exemplary embodiments of the invention and that modifications may be made without departing from the spirit and scope of the present invention.

What is claimed is:

1. An assembly adapted for use on a bucket of a loader, the assembly comprising:

the bucket defining a cavity for containing material and an orifice communicating to the cavity, wherein a periphery of the orifice is defined along a bottom portion thereof by a bottom lip of the bucket;

a material discharge component comprising:

a left-side arm and a right-side arm, with each arm being adapted to pivotally couple relative to the bucket;

a front wall section converging in a V-shape from a front end of the left-side arm and the right-side arm, with an opening being defined in the front wall section;

a top plate coupled to a top edge of the left-side arm and a top edge of the right-side arm; and a bottom plate extending rearwardly from a bottom edge of the front wall section, wherein the bottom plate terminates at an aft edge; and a first actuator coupled to one of the left-side arm and the right side arm and adapted to be coupled to the bucket, the first actuator further being adapted to operate the material discharge component between an open position and a closed position wherein the aft edge aligns with the bottom lip of the bucket so as to prevent the material from passing between the bottom plate and the bottom lip, whereby the material is dispensable through the opening when the bucket is tilted forwardly.

2. The assembly of claim 1, wherein the top plate is elevated from each of the left-side arm, the right-side arm, and the front wall section, wherein a forward edge of the top plate is coupled to the front wall section so as to terminate at the opening.

3. The assembly of claim 1, wherein each of the left-side arm and the right-side arm is adapted to couple to the bucket at a pivot, and the first actuator is coupled to an actuator coupling of the one of the left-side arm and the right-side arm.

4. The assembly of claim 1, further comprising a second actuator coupled to the other of the left-side arm and the right side arm.

5. A material discharging apparatus comprising:

a loader comprising a bucket; and an assembly used on the bucket of the loader, the assembly comprising:

a material discharge component comprising:

a left-side arm and a right-side arm, with each arm being pivotally coupled with the bucket;

a front wall section converging in a V-shape from a front end of the left-side arm and the right-side arm, with a forward-facing opening being defined in the front wall section;

a top plate coupled to a top edge of the left-side arm, a top edge of the right-side arm, and the front wall section so that a forward edge of the top plate terminates at the forward-facing opening; and a bottom plate extending rearwardly from a bottom edge of the front wall section; and a first actuator coupled to one of the left-side arm and the right side arm and coupled to the bucket, the first actuator further being adapted to operate the material discharge component between an open position and a closed position, whereby material is dispensable through the forward-facing opening when the bucket is tilted forwardly.

6. The material discharging apparatus of claim 5, wherein the loader is a self-loading wheel or track loader.

7. The material discharging apparatus of claim 6, wherein the self-loading wheel or track loader comprises articulating load arms to which the bucket is pivotally coupled.

8. The material discharging apparatus of claim 5, wherein the first actuator runs along an aft end of the bucket.

9. The material discharging apparatus of claim 8, wherein the first actuator is coupled to the bucket at a lower portion of the aft end.

10. The material discharging apparatus of claim 5, wherein the top plate is elevated from each of the left-side arm, the right-side arm, and the front wall section.

11. The material discharging apparatus of claim 5, wherein each of the left-side arm and the right-side arm is coupled to the bucket at a pivot that engages a first bucket bracket, and the first actuator is coupled to an actuator coupling of the one of the left-side arm and the right-side arm.

12. The material discharging apparatus of claim 5, further comprising a second actuator coupled to the other of the left-side arm and the right-side arm.

13. The material discharging apparatus of claim 5, wherein a bottom portion of the bucket of the loader is defined by a bottom lip, wherein the bottom plate of the material discharge component terminates at an aft edge, and where in the closed position the aft edge aligns with the bottom lip so as to prevent the material from passing between the bottom plate and the bottom lip.

14. A bucket of a front-end loader, the bucket comprising:

a material discharging apparatus pivotably coupled to an upper aft portion of the bucket so as to be movable between an open position and a closed position placing a forward-facing central dispensing opening forward of the bucket wherein an aft edge of a bottom plate of the material discharging apparatus aligns with a lip of a bottom edge of the bucket, whereby an enclosed structure is formed in the closed position so that when the bucket is tilted forwardly a material contained by the bucket is dispensable through the forward-facing central dispensing opening and the material is prevented from passing between the bottom plate and the bottom edge.

* * * * *